United States Patent [19]

Musha et al.

[11] 4,014,643

[45] Mar. 29, 1977

[54] ROTARY KILN

[75] Inventors: Keijiro Musha, Matsudo; Hajime Maeda, Yokohama, both of Japan

[73] Assignee: Almer Sangyo Kaisha, Ltd., Tokyo, Japan

[22] Filed: June 9, 1975

[21] Appl. No.: 585,122

[30] Foreign Application Priority Data

July 15, 1974 Japan ..... 49-80907

[52] U.S. Cl. ..... 432/118; 34/185; 159/4 SR

[51] Int. Cl.[2] ..... F27B 7/18

[58] Field of Search ..... 432/118; 34/185, 142; 159/4 SR, 9 A, 9 R

[56] References Cited

UNITED STATES PATENTS

| | | | |
|---|---|---|---|
| 1,954,401 | 4/1934 | Busch | 432/118 X |
| 2,314,836 | 3/1943 | Seil | 159/9 A |
| 3,145,979 | 8/1964 | Madsen | 159/9 A |
| 3,802,831 | 4/1974 | Woodward | 432/118 X |

*Primary Examiner*—John J. Camby

[57] ABSTRACT

A rotary kiln comprises a rotary drum having a large number of lifters along its inner wall. The end portion of each lifter which is extended interiorly of the rotary drum is bent in the rotational direction of the rotary drum. To the end of each lifter are attached a number of chain like fittings which makes sliding movements along the inner wall surface of the rotary drum and along the upper and lower faces of each lifter in accordance with the rotation of the rotary drum. The chain like fittings so act as to prevent a substance to be dried from adhering to the inner wall of the rotary drum and to the lifters through making sliding movements in accordance with the drum rotation. Further, since the chain like fittings act to break the substance into small pieces and to release it upon dropping due to their own weights, it is dried effectively.

12 Claims, 4 Drawing Figures

ROTARY KILN

BACKGROUND OF THE INVENTION

This invention relates to a rotary kiln for drying a slurry of organic waste or sewage sludge, and more particularly to a rotary kiln for drying a slurry or the like having high adhesion.

Generally, since the slurry or the like, if allowed to stand, becomes a cause of the public nuisance, it is subjected to incinerating treatment. Since, however, the slurry contains therein a large amount of water, the water content in the slurry is first removed by a drier and then incinerated by an incinerator. In order to heat the slurry positively and effectively, a usual kiln is provided with a rotary drum rotated while causing a heated gas to be passed therethrough. In this type of rotary kiln, the slurry is lifted by a large number of lifters provided on the inner wall of the rotary drum, to be released and dropped in accordance with the drum rotation, whereby the slurry is exposed to the heated gas to remove the water content in the slurry. Such rotary kiln, however, has the drawbacks that the slurry introduced into the rotary drum adheres to the inner wall of the rotary drum and to the lifters to be disabled from being effectively dried; and particularly in the inlet portion of the rotary drum the slurry adheres to the inner wall of this inlet portion to form a slurry layer, whereby the effective drying area of the rotary drum is reduced to decrease the drying efficiency. For this reason, in such usual dryer or usual rotary kiln, the rotary drum should necessarily be made large in length, resulting in large size and high cost. Further, the usual rotary kiln has the drawback after the drying treatment is performed, the slurry as adhered has to be forcibly removed through a manual operation.

Under these circumstances, there has been proposed a rotary kiln wherein loop chains are attached to the inner wall of the rotary drum in order to enhance the drying efficiency and perform an effective drying treatment. In such improved rotary kiln, the loop chains so act as to forcibly remove the slurry adhered to the inner wall of the rotary drum by applying a hammering force to this inner wall through dropping due to their own weights as well as by making sliding movements on or along the inner wall of the rotary drum. In the loop type rotary kiln, however, the rotary drum is vibrated due to the hammering effect of the loop chain upon the rotary drum, so that a mounting base for the rotary drum should have a vibration proof structure. As a result, the loop type rotary kiln becomes complicated in construction and high in manufacturing cost and, furthermore, intermittently produces noises. Further, this loop type rotary kiln has the drawback that where the loop chains are aranged with high density, they are inconveniently entangled with each other with the result that they fail to be attached in large number to render it difficult to remove the slurry sufficiently.

SUMMARY OF THE INVENTION

An object of the invention is to provide a rotary kiln capable of effectively drying a slurry or the like having high adhesion.

Another object of the invention is to provide a rotary kiln capable of forcibly removing a slurry or the like about to adhere.

Another object of the invention is to provide a rotary kiln capable of causing an eddy to occur in a heated gas used.

Another object of the invention is to provide a rotary kiln having preheating means.

Another object of the invention is to provide a small-sized and inexpensive rotary kiln capable of preventing generation of noises.

For achieving the above objects, the rotary kiln according to the invention is constructed such that a large number of lifters are arranged on the inner wall of the rotary drum axially of the rotary drum; the interiorly projecting end portion of each lifter is bent in the rotational direction of the rotary drum; and a number of chain like fittings are attached to the interiorly projecting end of each lifter in such a manner as to be axially spaced from each other. Each chain like fitting is so formed as to have a length capable of preventing one fitting of one lifter from being entangled with the bent end portion of another lifter adjacent said one lifter. Accordingly, the chain like fittings so act as to remove the substance to be dried which is about to adhere such as said slurry or the like, by making sliding movements on or along the inner wall of the rotary drum and the upper and lower faces of the lifters in accordance with the rotation of the rotary drum. Thus, the chain like fittings prevent such substance to be dried from adhering.

According to the invention, it is indeed possible to cause an eddy to take place in the heated gas by suspending and accumulating another type of chain like fittings within the rotary drum, especially by suspending them, but construction may be so made that a large eddy is caused to occur through forming barrier walls for interrupting the flow of the heated gas by attaching this type of chain like fittings directly to the inner wall of the rotary drum.

Further, if arrangement is so made that the substance to be dried is preheated by disposing preheating means in the neighbourhood of that throwing-in port of the rotary kiln through which said substance is thrown into the rotary drum, even a substance containing therein a large amount of water will be able to be effectively dried.

The above and other objects and novel features of the invention will become more apparent from the following detailed description when read in connection with the appended drawings. But the drawings are for the purpose of illustration only and therefore do not impose a limitation upon the technical scope of the invention.

DETAILED DESCRIPTION OF THE PREFERRED EMBODIMENTS

Figure 1:
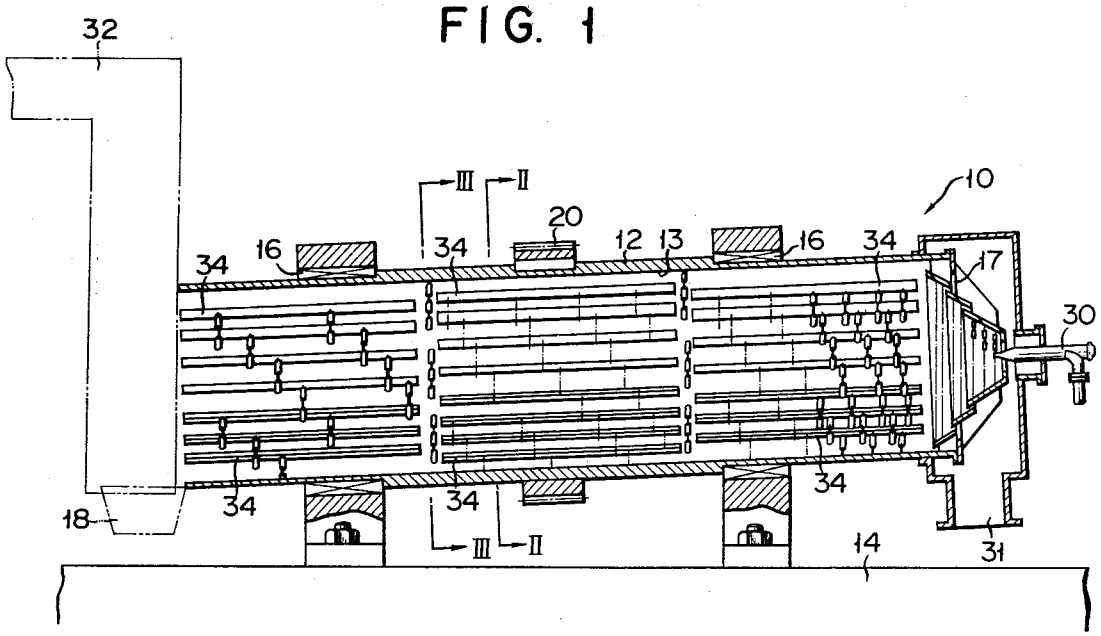
FIG. 1 is a schematic longitudinal sectional view illustrating a rotary kiln according to a preferred embodiment of the invention.

As illustrated in FIG. 1, a rotary kiln 10 according to the invention comprises a rotary drum 12 rotated while causing a drying heated gas such as heated air to be passed through its interior. The rotary drum 12 is rotatably supported by two bearings 16 on a mounting base 14 in a state so inclined that it becomes high on the side of a throwing-in port 17 through which a substance A to be dried such as a slurry or the like is introduced into the drum interior and becomes low on the side of a discharge port 18 through which the substance A is discharged into the drum exterior. A gear 20 is fixedly fitted over the rotary drum 12 at an intermediate portion thereof, and this gear is intermeshed with a pinion 22 rotatably supported by a supporting member 24 erected on the mounting base 14. As seen from FIG. 2, the pinion 22 is connected through a power driven chain 28 to the power shaft 26 of a motor 23 fixed on the mounting base 14, thereby causing the rotary drum 12 to be rotated. Instead of the gear driven mechanism using the gear 20 and pinion 22 there may be utilized a chain driven mechanism using a pair of chain gearings. A pipe 30 for feeding into the rotary kiln 10 the substance A to be dried such as a slurry of sewage sludge is opened into the throwing-in port 17 of the rotary kiln 10, and the slurry A is forcibly fed-in by a pump (not shown) through the pipe 30. Further, the slurry A can also be conveyed into the throwing-in port 17 utilizing a screw conveyor. The slurry A after dried is discharged through the discharge port 18, and is supplied into, for example, an associated incinerator and cremated there. The heated gas (generally, heated air) heated to, for example, 500° C for drying the slurry A is sent into the rotary kiln 10 through a supply duct 31 and, after passed through the interior of the rotary drum 12, is exhausted through an exhaust duct 32. This exhausted gas may be utilized for burning, through causing the exhaust duct 32 to communicate with said associated incinerator.

In the inner wall 13 of the rotary drum 12 are inwardly projectively disposed a large number of lifters 34 axially extending in such a manner as to be circumferentially spaced at prescribed intervals from each other. The lifters 34 are more preferred to be arranged in rows or helically in a state cut into short pieces than to be integrally arranged in a manner extending from the throwing-in port 17 to the discharge port 18, and, in this embodiment, is arranged helically in a state cut into short pieces. As seen from FIG. 2, in the illustrated embodiment, the lifter 34 is projected toward the center of the rotary drum 12, but it will be easily understood that the lifter 34 is not limited to such projecting form. Further, the projecting end portion 35 of each lifter 34 is bent at a prescribed angle in a direction (indicated by an arrow 36) in which the rotary drum 12 is rotated. The bending angle of each projecting end portion 35 can be properly determined depending upon the amount and nature of the slurry A as thrown-in so that the action of lifting the thrown-in slurry A may be smoothly effected and that the thrown-in slurry A may be gradually released and dropped as it is upwardly moved with the rotation of the rotary drum 12.

Figure 2:
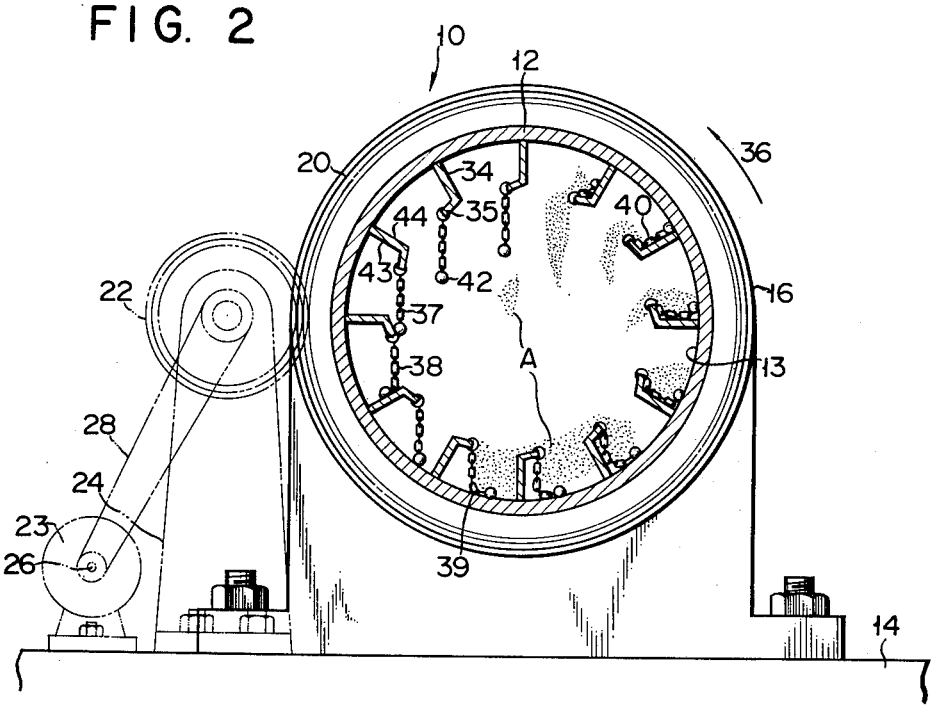
FIG. 2 is a cross sectional view taken along the line II—II of FIG. 1, illustrating the construction and effect of chain like fittings attached to the lifters, and driving means for driving the rotary drum.

As clear from FIG. 2, a number of metal-made chain like fittings such as chains, though those of the different lifters 34 are only representatively denoted by reference numerals 37, 38, 39 and 40, are attached, in a manner axially spaced from each other, to the tip end of the bent end portion 35 of each lifter 34. Although these chain like fittings 37 to 40 have the same configuration and construction, they are distinguished from each other in terms of their rotational positions for the purpose of facilitating their action and effect. The chain like fittings 37 to 40 are each so formed as to have a length associated with the circumferential interval between two adjacent lifters 34, that is, a length (see the chain like fitting 37) capable of preventing the chain like fitting of one lifter from being entangled with the bent end portion of another lifter adjacent said one lifter in the direction of the drum-rotation. Further, the chain like fittings 37 to 40 can each be used in a state formed into a loop by attaching both ends of the chain like fitting to the bent end portion 35 of the lifter 34.

The slurry A thrown from the throwing-in port into the rotary kiln 10 through the pipe 30 is upwardly lifted by the lifter 34 in accordance with the rotation of the rotary drum 12 and is released and dropped from the lifter 34. While being repeatedly subjected to such action of the lifter 34, the slurry A is brought into contact with the heated air sent from the supply duct 31 and is dried. While being subjected to this drying treatment, the slurry A is gradually transferred toward the discharge port 18 due to the rotary drum 12 being inclined. In this drying process, the slurry A has a tendency to adhere to the inner wall 13 of the rotary drum and to the upper and lower faces 43, 44 of the lifter 34. Part of the slurry A, however, is not only accumulated on the chain like fitting indicated by the reference numeral 39, but also the ambient slurry A which has failed to be accumulted on the chain like fitting 39 is forcibly removed from the inner wall 13 because the chain like fitting 39 makes sliding movements on or along the inner wall 13 in accordance with the rotation of the rotary drum 12. In addition to such prevention of the slurry A from adherence to the inner wall 13, the slurry A about to adhere to the upper face 43 is forcibly removed before adhering to the upper face 43 of the lifter 34 because the chain like fitting denoted by the reference numeral 40 makes sliding movements on the upper face 43 in accordance with the rotation of the rotary drum 12. The slurry A is gradually released from the lifter 34 in accordance with the drum rotation, and when the lifter has arrived at a certain rotational position, the residual slurry A on the lifter 34 is mostly released therefrom due to the chain like fitting being suspended because of its own weight. After this release, the chain like fitting makes sliding movements on the lower face 44 of the lifter 34 as indicated by the reference numeral 38, thereby causing the slurry A about to adhere to this lower face to be forcibly removed before adhering thereto.

As mentioned above, the chain like fittings 37 to 40 each not only directly prevent part of the slurry A from adhering to the inner wall 13 of the rotary drum 12 by having said part accumulated on itself, but also prevent the slurry A about to adhere to the upper and lower faces 43, 44 of each lifter 34 from adhering to these faces by a forcible removal through the sliding movements of each chain like fitting made in accordance with the drum rotation. Further, since the slurry A is gradually released from the lifter 34 in accordance with the drum rotation, it is sufficiently exposed to the heated air. In addition, since the residual slurry A is scattered due to the chain like fitting being suspended owing to its own weight and is thereby broken into small pieces, it can be dried with high efficiency. In this case, if necessary, a weight 42 is attached to the tip end of each chain like fitting, thereby promoting such fractionization. Further, since the metal-made chain like fitting is capable of absorbing heat from the heated air, the slurry A contacting with the chain like fitting can be subjected to preliminary heating. Further, aluminizing the chain like fitting would not only serve to prevent it from being eroded but also enable its heat-absorbing property to be promoted. Further, the chain like fitting not only makes sliding movements in accordance with the drum rotation but is also shrunk due to the mechanical gathering of its rings constituting each chain like fitting, thereby promoting the breakage of the slurry A into small pieces. Further, the chain like fittings not only compel the slurry A about to adhere thereto to be finely broken and dropped therefrom owing to their mutual collisions, but also their swinging movements cause the heated air to undergo an eddy, thereby increasing the drying efficiency. Further, since it does not happen that the hammering of the inner wall 13 occurs as in the loop chain, the rotary kiln neither produces any noise nor is vibrated with the result that it can be made simple in configuration, accordingly in construction. As seen from FIG. 1, the chain like fittings can be also arranged helically on the lifters 34. Further, since the slurry A is most apt to adhere in the neighbourhood of the throwing-in port 17, it is preferred to promote the drying efficiency by arranging the chain like fittings with high density in the neighbourhood of the throwing-in port 17. In contrast, the chain like fittings may be arranged with low density in the neighbourhood of the discharge port 18 because the slurry A transferred up to this neighbourhood is already dry-treated to a considerable extent.

Figure 3:
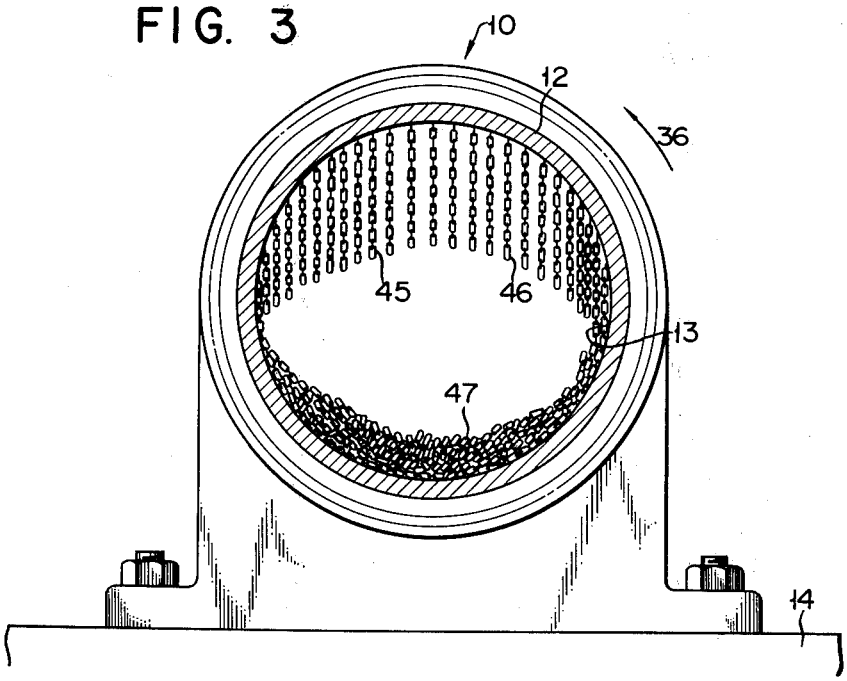
FIG. 3 is a cross sectional view taken along the line III—III of FIG. 1, only illustrating the action or effect of chain like fittings forming barrier walls for interrupting the flow of a heated gas used.

As shown in detail in FIG. 3, another large number of chain like fittings 45 are attached directly to the inner wall 13 of the rotary drum 12 along planes intersecting the inner wall 13. In the illustrated embodiment, there are utilized the intersecting planes intersecting the rotary drum 12 at right angles thereto and located at the space portions between the two adjacent circumferential rows, but this invention is not of course limited thereto. The chain like fittings 45 are arranged on the inner wall along the intersecting planes at prescribed intervals. The chain like fittings 45 form an upper barrier wall 46 and a lower barrier wall 47 for interrupting the flow of the heated air, by being suspended and by being accumulated, respectively. Accordingly, the flow of the heated air is partially interrupted by the barrier walls 46, 47, particularly by the upper barrier wall 46, thereby enabling an eddy flow to occur. For this reason, the heated air is sufficiently spread or diffused within the rotary drum 12 and simultaneously the stay period during which the heated air stays within the rotary drum becomes long. Thus, the drying efficiency of the rotary kiln 10 can be increased utilizing the heated air effectively. Further, the chain like fittings 45 accumulated downwardly of the rotary drum interior to form the lower barrier wall 47 have the slurry A held thereon to prevent the slurry A from adhering to the inner wall 13 and simultaneously to stop temporarily the transference of the slurry A, thus enabling the drying efficiency thereof to be elevated. Further, the chain like fittings 45 have the same functions as in the above-mentioned chain like fittings 37 to 40—the sliding movements along the inner wall 13, the dropping due to their own weights, etc.. Of course, it is preferred also with respect to these chain like fittings 45 that they are subjected to aluminizing treatment as in the case of the above-mentioned chain like fittings 37 to 40.

Figure 4:
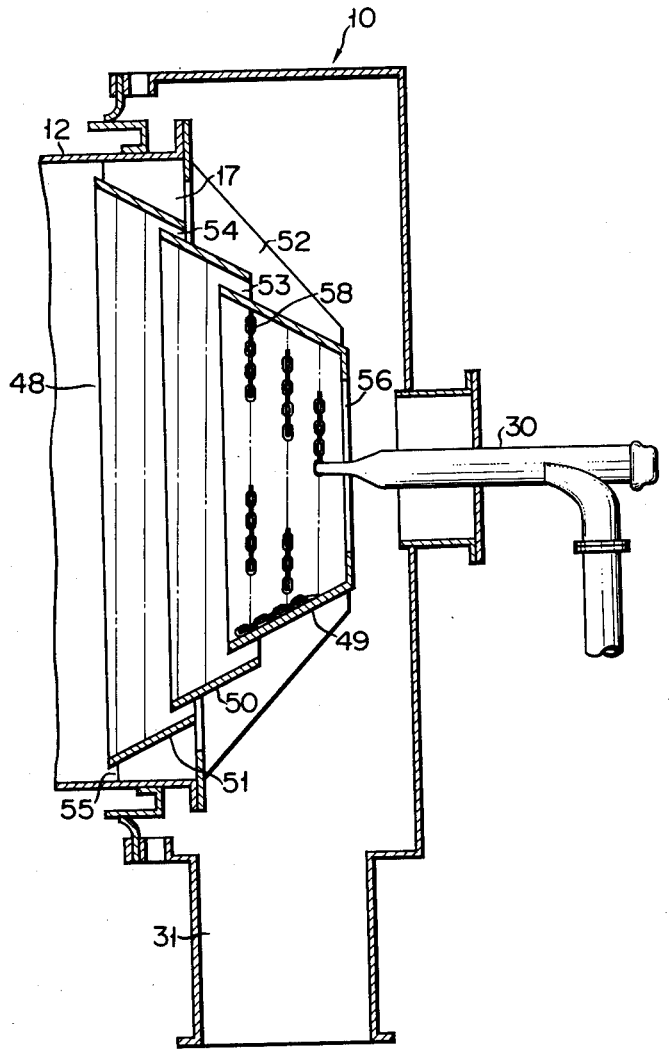
FIG. 4 is an enlarged sectional view illustrating that portion of the embodiment illustrated in FIG. 1 in which preheating means is provided.

The rotary kiln 10 has at its throwing-in port 17 a preheating assembly 48 as preliminary heating means. As shown in detail in FIG. 4, this preheating assembly 48 is composed of three frusto-conical shell members 49, 50 and 51 both ends of each of which are opened and the outer diameters of which are stepwise different from each other. The preheating assembly 48 is constructed such that the large diameter section of the outermost conical member 49 and the large diameter section of the conical member 50 are disposed within the small diameter section of the conical member 50 and the small diameter section of the innermost conical member 51, respectively, in such a manner as to be spaced from the latter small diameter sections, respectively. The preheating assembly 48 is secured to the rotary drum 12 through a holding member 52. Accordingly, spaces or passageways 53, 54 and 55 for permitting the heated air from the supply duct 31 to flow into the rotary drum 12 are formed between the conical shell members and between the innermost conical member 51 and the rotary drum 12. Further, the heated air is also entered into the rotary drum 12 through an opening 56 formed at the small diameter section of the outermost conical member 49. Further, a large number of metal-made chain like fittings 58 are attached to the inner walls of the conical members 49 to 51 in a manner axially and circumferentially spaced from each other. In FIG. 4, for clarification, the chain like fittings 58 attached to the inner wall of the conical member 49 are schematically shown with those of the remaining conical members omitted. The same fitting as said chain like fittings 37 to 40 can be utilized as the fitting 58.

While the preheating assembly 48 is rotated jointly with the rotary drum 12, the heated air is sent into the rotary drum 12 from the supply duct 31. Thereafter, by driving the pump (not shown) the slurry A is fed into the rotary kiln 10 from the pipe 30. The preheating assembly 48 is not merely heated when the heated air passes through the spaces 53, 54 and 55 and the opening 56. That is, since the preheating assembly 48 itself is exposed into the supply duct 31, it is heated to a sufficient extent. The slurry A sent into the conical members 49 to 51 through the pipe 30 difficulty adheres to the inner walls of the respective conical members. This is not only because these inner walls are heated but also because the water content in the slurry A is evaporated to form a vapour film on the inner wall surfaces of the conical members. Further, since the chain like fittings 58 make sliding movements over the inner wall surface of the conical member 49 in accordance with the rotation of the preheating assembly 48 forcibly to prevent the slurry A about to adhere from actually adhering to this inner wall surface, the slurry A is dried somewhat and then transferred to the next conical member 50. Thereafter, the slurry A is subjected to the same actions also in the conical members 50 and 51. Therefore, the slurry A passed through the preheating assembly 48 is preheated and dried to have its water content removed from itself to a considerable extent, so that its adhering property is deteriorated. Thereafter, the slurry A is supplied further into the rotary drum 12 to be dried by the chain like fitting 45 as well as the lifters 34 and the chain like fittings 37 to 40.

The rotary kiln according to the invention is not limited to the configuration shown in the preceding embodiment, but includes, as will be easily understood from the foregoing description, a variety of modifications made without departing from the object and scope of the invention.

What we claim is:

1. A rotary kiln comprising a rotary drum having a throwing-in port, the rotary drum being rotated while a heated gas is passed therethrough for drying a slurry or the like containing therein water and thown through the throwing-in port of the rotary drum, wherein said rotary drum includes a large number of lifters which are disposed in a manner circumferentially spaced from each other and extending axially of the rotary drum along the inner wall thereof, the lifters having bent end portions projecting internally of the rotary drum and being bent in the rotational direction of the rotary drum, and wherein the rotary drum further includes a large number of metal-made chain-like first fittings attached to the bent end portion of each of said lifters, said first fittings having a length at least as great as the maximum distance between the bent end portion of one of said lifters and the lower face of another lifter adjacent said one lifter in the direction of the drum rotation but less than the distance between the bent end portions of said one lifter and said adjacent lifter, so as to prevent the first fitting of said one lifter from becoming entangled with the bent end portion of said adjacent lifter while permitting sliding movements by the first fitting of said one lifter on the lower face of said adjacent lifter.

2. A rotary kiln according to claim 1 wherein said first fittings of said lifters each have one end attached to said bent end portion of said lifter and the other end rendered free.

3. A rotary kiln according to claim 2 wherein said first fittings of said lifters are arranged with high density in the neighborhood of said throwing-in port for said slurry or the like.

4. A rotary kiln according to claim 1 wherein said rotary drum includes along planes intersecting its inner wall a large number of metal-made chain-like second fittings which form barrier walls for interrupting the flow of said heated gas, by being suspended and accumulated.

5. A rotary kiln according to claim 1 which further comprises preliminary heating means for preheating said slurry or the like, said preliminary heating means being located at said throwing-in port and there secured to said rotary drum, said preliminary heating means being so formed as to permit the passage of said slurry or the like through its interior and to permit the passage of said heated gas through its interior and around its exterior.

6. A rotary kiln according to claim 5 wherein said preliminary heating means is a frusto-conical shell assembly in which a number of frusto-conical shell members, both ends of each of which are opened, are arranged in a manner that the large diameter portion of one of said conical shell members is freely and concentrically disposed within the small diameter portion of the inner adjacent one of said conical shell members.

7. A rotary kiln according to claim 6 wherein said conical shell members of said preliminary heating means are each provided with a large number of metal-made chain-like third fittings spaced from each other axially and circumferentially of said preliminary heating means.

8. A rotary kiln according to claim 3 wherein said rotary drum includes along planes intersecting its inner wall a large number of metal-made chain-like second fittings which form barrier walls for interrupting the flow of said heated gas, by being suspended and accumulated.

9. A rotary kiln according to claim 8 which further comprises preliminary heating means for preheating said slurry or the like, said preliminary heating means being located at said throwing-in port and there secured to said rotary drum.

10. A rotary kiln according to claim 9 wherein said preliminary heating means is a frusto-conical shell assembly in which a number of frusto-conical shell members, both ends of each of which are opened, are arranged in a manner that the large diameter portion of one of said conical shell members is freely and concentrically disposed within the small diameter portion of the inner adjacent one of said conical shell members.

11. A rotary kiln according to claim 10 wherein said conical shell members of said preliminary heating means are each provided with a large number of metal-made chain-like third fittings spaced from each other axially and circumferentially of said preliminary heating means.

12. A rotary kiln according to claim 11 wherein at least one of said first, second or third fittings are aluminized.

* * * * *